US007625229B2

(12) United States Patent
Cross et al.

(10) Patent No.: US 7,625,229 B2
(45) Date of Patent: Dec. 1, 2009

(54) TAMPER EVIDENT CONNECTOR SYSTEM

(75) Inventors: Scott M Cross, Winston-Salem, NC (US); David A Klein, Kernersville, NC (US); Joel D Sandburg, Winston-Salem, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/077,097

(22) Filed: Mar. 17, 2008

(65) Prior Publication Data

US 2009/0233478 A1 Sep. 17, 2009

(51) Int. Cl.
*H01R 13/58* (2006.01)

(52) U.S. Cl. ..... 439/468; 439/902; 439/953

(58) Field of Classification Search ..... 439/468, 439/953, 304, 473, 471, 446, 372, 902
See application file for complete search history.

(56) References Cited

U.S. PATENT DOCUMENTS

D312,820 S * 12/1990 Collins et al. ..... D14/240
5,007,858 A * 4/1991 Daly et al. ..... 439/498
5,071,369 A * 12/1991 Denlinger et al. ..... 439/595
5,073,127 A * 12/1991 Daly et al. ..... 439/473
5,310,352 A * 5/1994 Mroczkowski et al. ..... 439/76.1
5,376,016 A * 12/1994 Inaba et al. ..... 439/364
5,820,401 A * 10/1998 Hasz et al. ..... 439/364
5,964,598 A * 10/1999 Gonzales ..... 439/133
5,964,621 A * 10/1999 Wolla et al. ..... 439/595
5,993,255 A * 11/1999 Yurko ..... 439/595
6,004,158 A * 12/1999 Ward ..... 439/595
6,056,581 A * 5/2000 Rothenberger ..... 439/372
6,099,342 A * 8/2000 Letourneau ..... 439/372
6,257,918 B1 * 7/2001 Yamamoto ..... 439/364
6,305,990 B1 * 10/2001 Ward ..... 439/752
6,419,522 B1 * 7/2002 Bonilla ..... 439/595
6,522,532 B2 * 2/2003 Liao et al. ..... 361/686
6,773,277 B2 * 8/2004 Issa ..... 439/133
6,811,415 B2 * 11/2004 Chen ..... 439/133
6,896,535 B2 * 5/2005 Yamada et al. ..... 439/289

* cited by examiner

*Primary Examiner*—Michael C Zarroli
*Assistant Examiner*—Harshad C Patel

(57) ABSTRACT

An electrical assembly is disclosed that provides evidence of tampering. The assembly includes a plug housing with a seal cover attached thereto, the seal cover including latching arms. A wire dress cover is attached over the seal cover, and a locking element is placed through the wire dress cover and is rotatably latched in place to the latching arms. The locking element overlies a jack screw, which prevents the disconnection of the plug housing or removal of a wire cover without first removing the locking element.

19 Claims, 12 Drawing Sheets

TAMPER EVIDENT CONNECTOR SYSTEM

BACKGROUND OF THE INVENTION

The present disclosure relates to electrical connector plug assemblies and more particularly to plug assemblies which are mateable to a device that requires evidence of being tampered with.

There are numerous applications, particularly in the automotive industry, whereby a plug assembly is connected to an electronic control unit (ECU) which provides I/O connections between the electronics and a drive or control system/component. These connections provide for the controls of various vehicles or equipment, which could be automobiles, other similar devices such as construction equipment, or any industrial/commercial/consumer equipment that requires tamper restrictions where an ECU controls various dynamic situations on the application. For example, the ECU may control such values as maximum rpm or maximum torque, and the like. These data points and/or settings are established by the original equipment manufacturer (OEM) in order that the maximum safe working conditions for various components are not exceeded, preventing components from being stressed beyond their designed limitations.

However, users attempt to push the limits of the working parameters or gain additional functions of the equipment and, in some cases, actually reprogram the working limits of the various components by gaining access to the electrical terminals or "unmating" the connector and being able to remove or re-program certain electrical terminals and/or terminal locations. In some cases, re-programming the computer to make more power may not damage the equipment, but instead damage a system or component that was not designed to handle the additional power or other demand placed on it. In order for the OEMs to know, for warranty purposes, whether a connector assembly and/or its associated ECU have been tampered with, it would be advantageous to provide a connector assembly which provides evidence of tampering. These and other objects have been accomplished as provided herein.

BRIEF SUMMARY OF THE INVENTION

The objects were accomplished by providing an electrical connector assembly for attachment to a mating device, comprising a plug housing assembly; an attachment mechanism for attaching the plug housing assembly to the mating device; a wire dress cover attached to the plug housing assembly, with an access opening communicating with the attachment mechanism; and a locking element, receivable in the access opening and covering the attachment mechanism, and being retainable to the plug connector.

In an another embodiment an electrical connector assembly comprises a first housing; a second housing latched to the first housing, the second housing having latching arms with latching surfaces; a cover attached to the first and second housing, with an access opening accessing the latching arms; and a locking element, receivable in the access opening and retainable to the latching arms of the cover, retaining the cover and the second housing together.

DETAILED DESCRIPTION OF THE DRAWINGS

Figure 1:
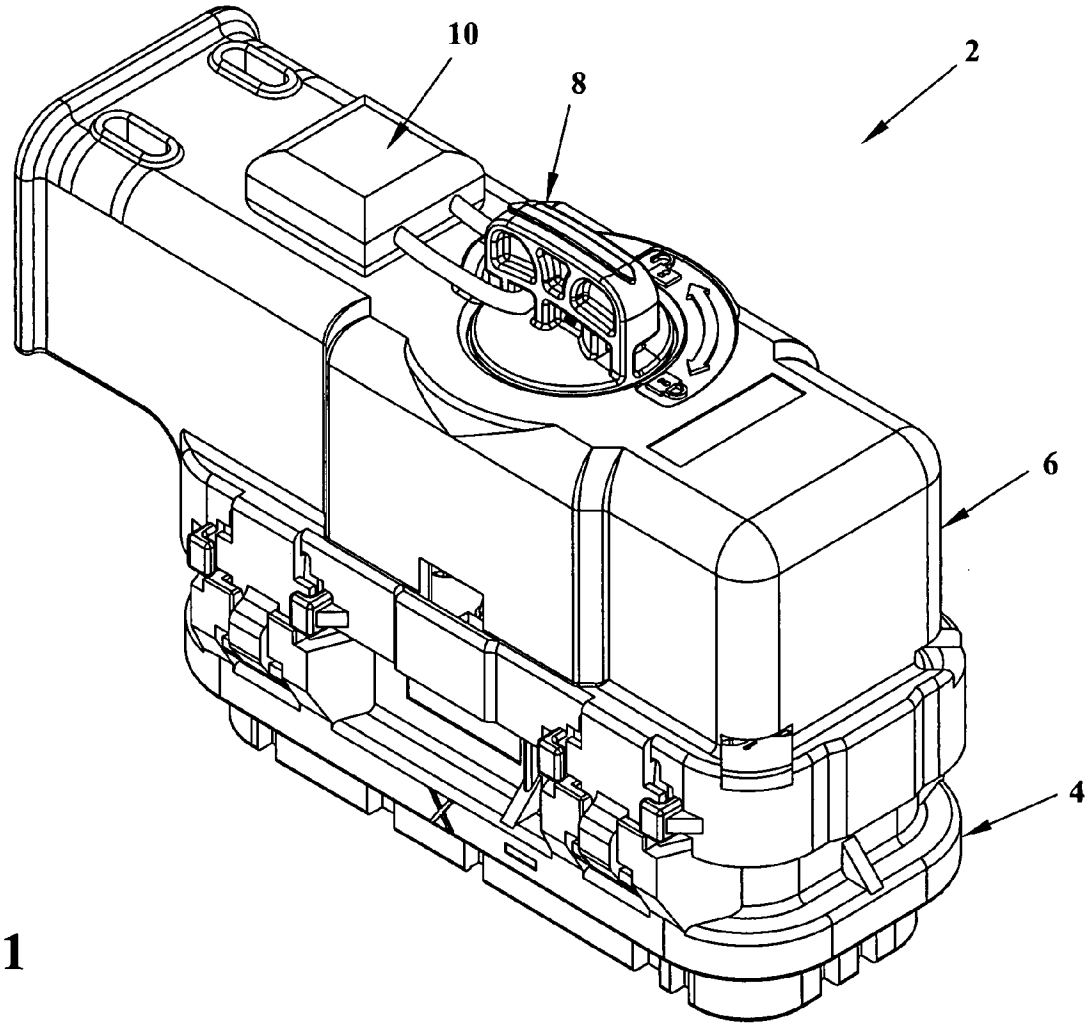
FIG. 1 shows a perspective view of the connector assembly of the present invention.
Figure 2:
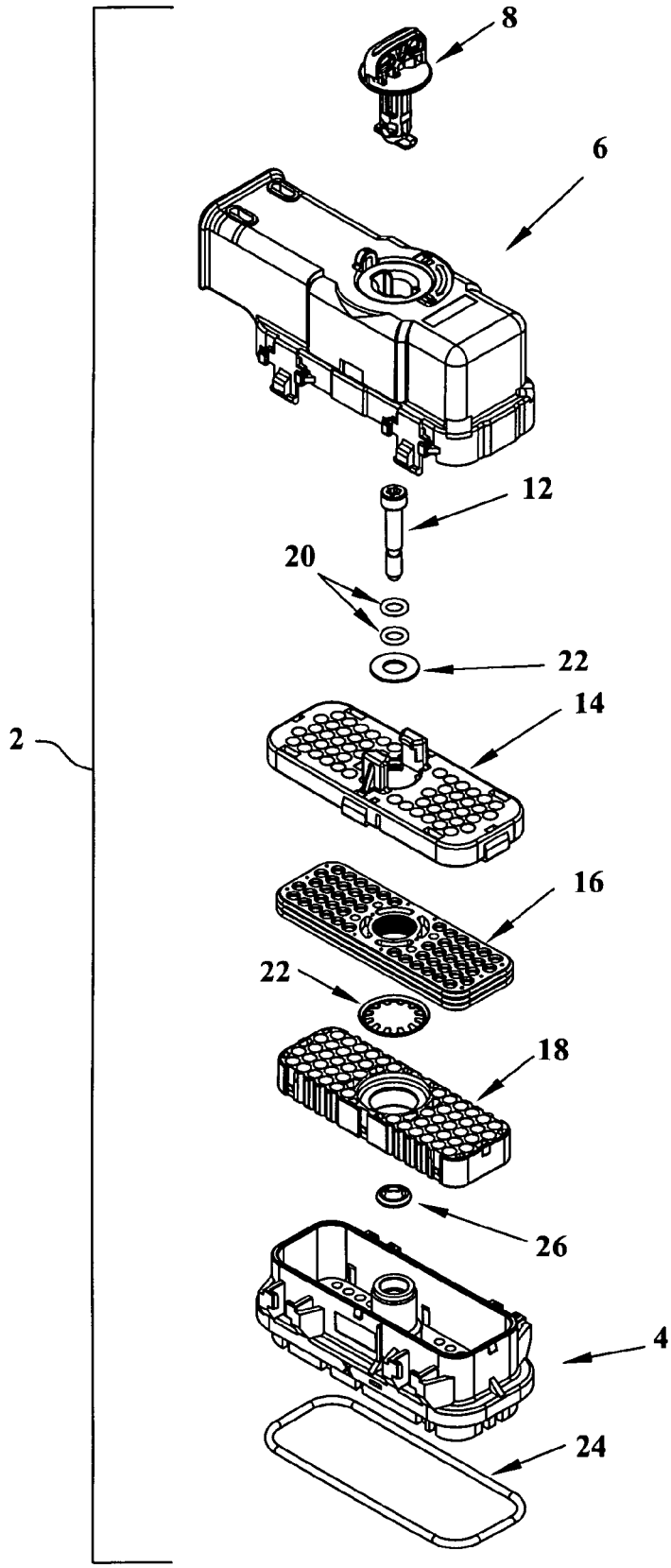
FIG. 2 shows an exploded view of the connector assembly of FIG. 1.

With respect first to FIG. 1, an electrical connector assembly 2 is shown having a plug housing 4, a wire dress cover 6, and a locking element 8, where the locking element 8 could be fixedly retained to the wire dress cover by way of a serialized lock wire 10. It should be appreciated that the electrical connector assembly 2 is the type which could be connected to an electronic control unit (ECU) in an equipment application such as an automotive, construction vehicle, or any industrial/commercial/consumer equipment that requires tamper restrictions. With reference now to FIG. 2, the electrical connector assembly 2 is shown in an exploded view and which further comprises an attachment mechanism 12 in the form of a jack screw, a seal cover 14, a mat seal 16 and a contact retention insert 18. Such items as O-rings 20, fastening items such as washers 22, O-ring 24, and retaining nut 26 may also be included.

Figure 3:
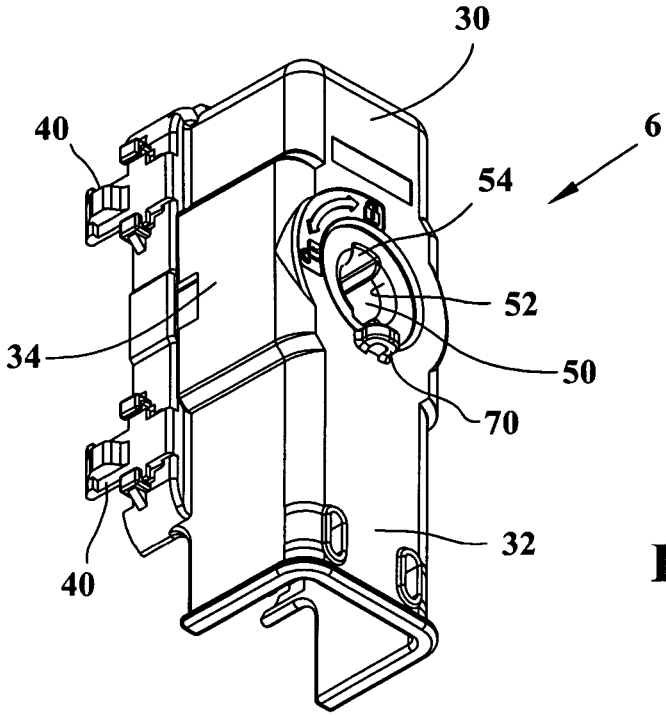
FIG. 3 shows a top perspective view of the wire dress cover of FIG. 1.
Figure 4:
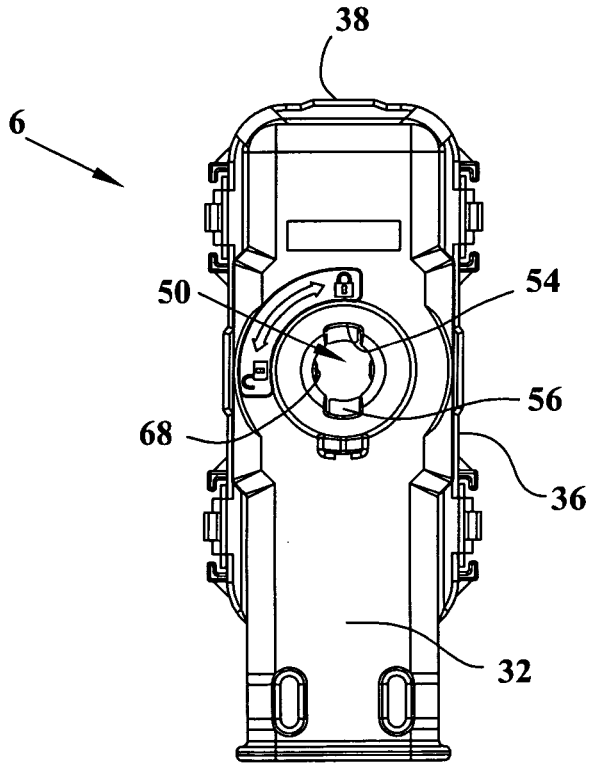
FIG. 4 shows a top plan view of the wire dress cover of FIG. 3.
Figure 6:
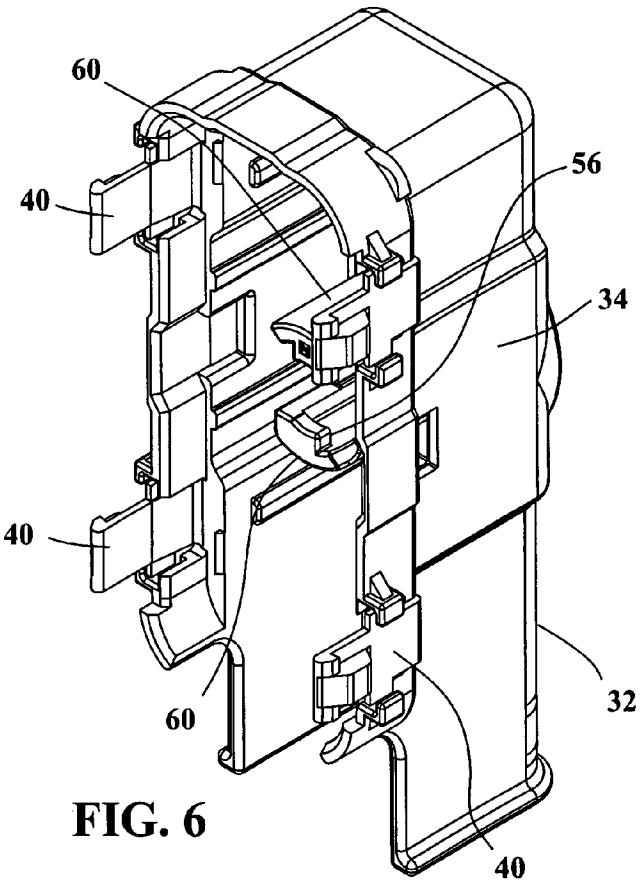
FIG. 6 shows a bottom perspective view of the wire dress cover of FIGS. 3-5.
Figure 5:
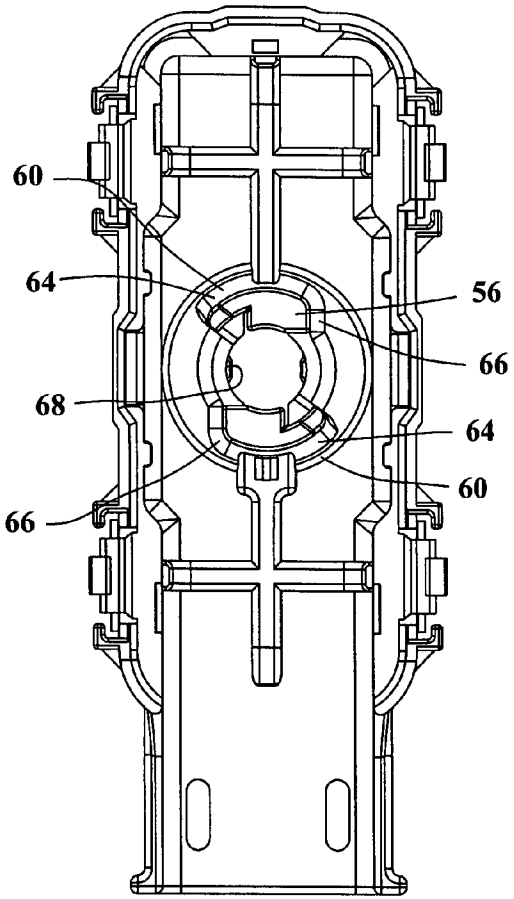
FIG. 5 shows a bottom plan of the wire dress cover of FIGS. 3 and 4.

With reference now to FIGS. 3-6, the wire dress cover 6 will be described in greater detail. With reference first to FIG. 3, the wire dress cover 6 is comprised of a top wall 30 having a wire dress shroud at 32. Wire dress cover 6 further includes side walls 34, 36 and end wall 38 where each of the side walls 34, 36 includes latches 40 extending downwardly. Wire dress cover 6 also includes an access opening 50 in the form of an alignment keyway having a cylindrical wall 52 and keyway slots 54 as best shown in FIG. 4. Each of the keyway slots includes a stop 56 aligned with each of the keyway slots 54. Keyway slots 54 are defined within an alignment keyway which is defined by posts 60 which extend downwardly from top wall 30 as best shown in FIGS. 5 and 6. Each of the posts includes an arcuate wall 64 and a stop wall 66. Access opening 50 also includes detents 68 as best shown in FIGS. 4 and 5. Finally, and as best shown in FIG. 3, wire dress cover 6 includes a lock wire tab 70 having a through hole.

Figure 7:
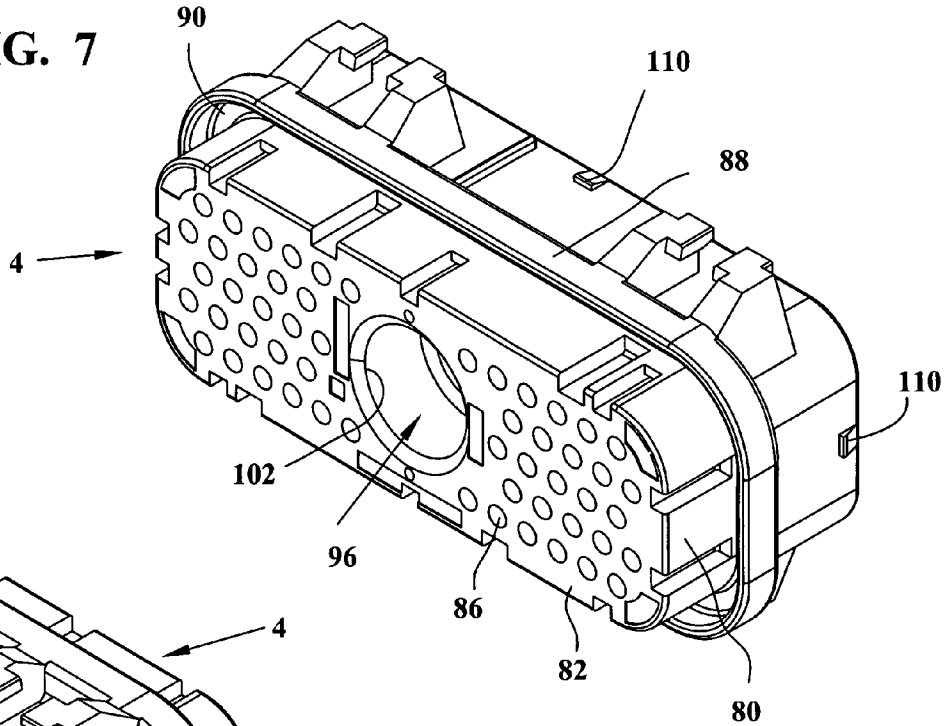
FIGS. 7 and 8 show opposite side perspective views of the plug housing shown in FIG. 2.
Figure 8:
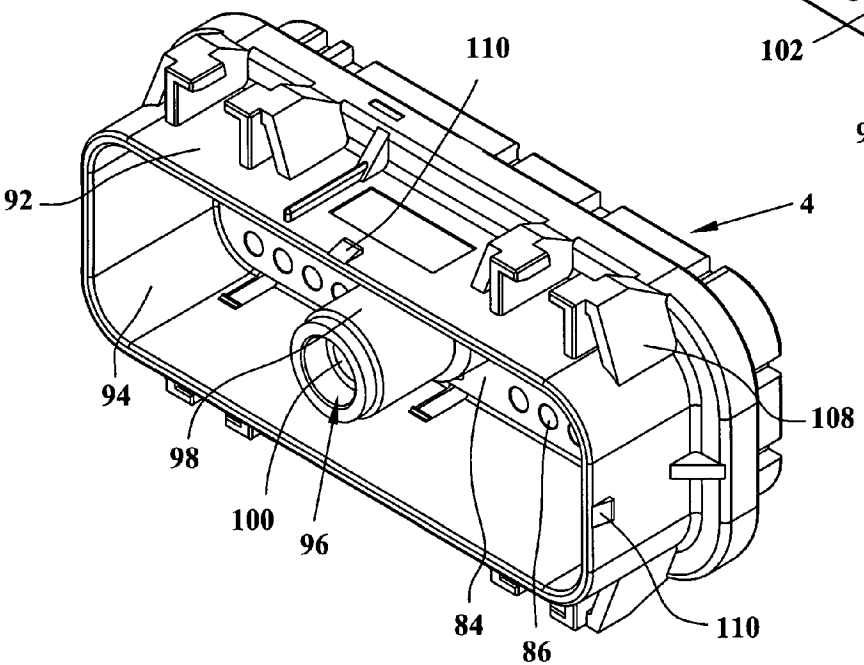

With respect now to FIGS. 7 and 8, the plug housing 4 is shown in greater detail. Plug housing 4 generally includes a housing body portion 80 having a front face 82, a rear face 84 and contact receiving apertures 86 extending therethrough. Plug housing 4 further includes a forwardly facing shroud 88 defining a peripheral inner channel 90, which may receive O-ring 24, and further includes a rearwardly facing shroud 92 which defines an inner space 94. A through bore 96 is defined by a tubular wall 98 extending from the inner surface 84 which has an inner diameter 100 dimensioned to receive the shank of jack screw 12, and which opens up into an enlarged diameter section 102 (FIG. 7) which may receive the threaded portion of jack screw 12. Plug housing 4 further includes complementary latching members 108 which cooperate with latches 40 on the wire dress cover 6 and includes latches 110 as described further herein.

Figure 10:
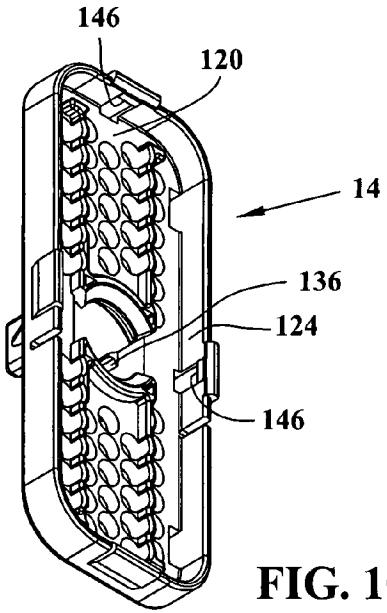
FIG. 10 shows an inside perspective view of the seal cover from the opposite side as that shown in FIG. 9.
Figure 11:
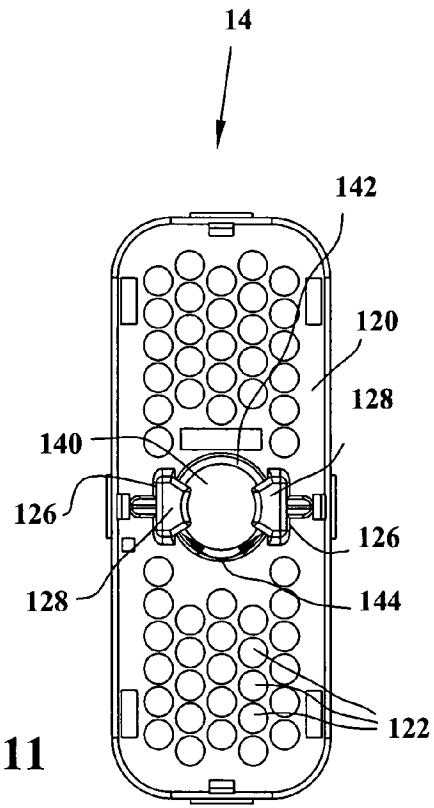
FIG. 11 shows a top plan view of the seal cover shown in FIG. 9.
Figure 9:
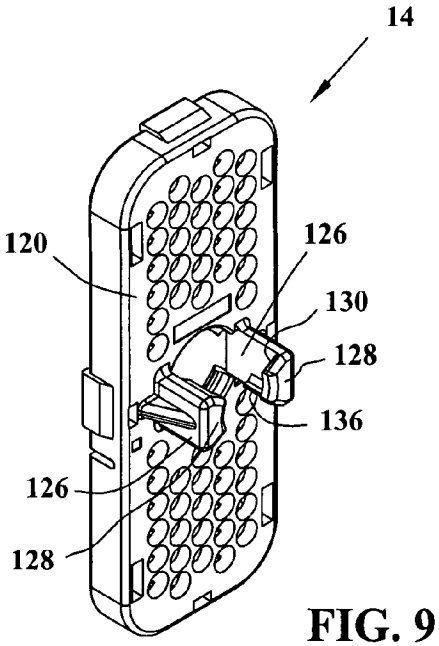
FIG. 9 shows a top perspective view of the seal cover shown in FIG. 2.

With respect to FIGS. 9-11, seal cover 14 will be described in greater detail. Seal cover 14 includes a body portion 120 having a plurality of wire and contact receiving openings 122 extending therethrough and a shroud wall 124 which extends peripherally around the body portion to define a seal receiving area between the body portion 120 and shroud wall 124. As shown best in FIG. 9, seal cover 14 includes fixed latching members 126 which may be provided in the form of arms which include shoulders 128 which define inner latching edges 130. Arms 126 include on an inside thereof stop members 136 as best shown in FIGS. 9 and 10. As shown best in FIG. 11, arms 126 flank an opening 140 having a shoulder at 142. As shown best in FIG. 11, arms 126 are diametrically opposed to each other such that a radial opening 144 is defined between opposed shoulders 128. Finally, latches 146 (FIG. 10) are provided on an inner surface of wall 124 and cooperate with latches 110 (FIGS. 7 and 8) provided on plug housing 4.

Figure 13:
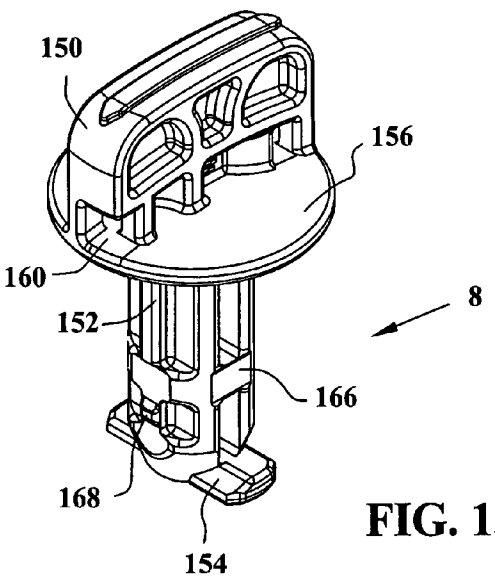
FIGS. 12 and 13 show perspective views of the locking element of the present invention.
Figure 14:
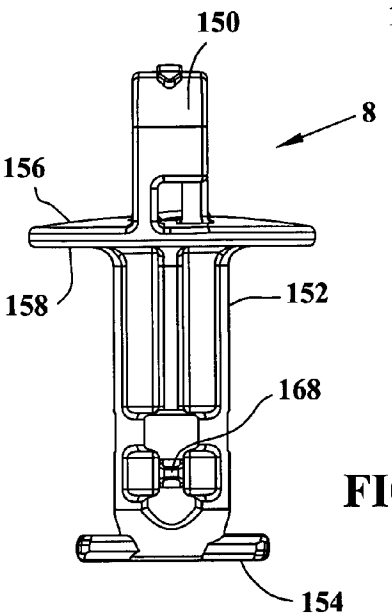
FIG. 14 shows a side plan view of the locking element of FIGS. 12 and 13.
Figure 12:
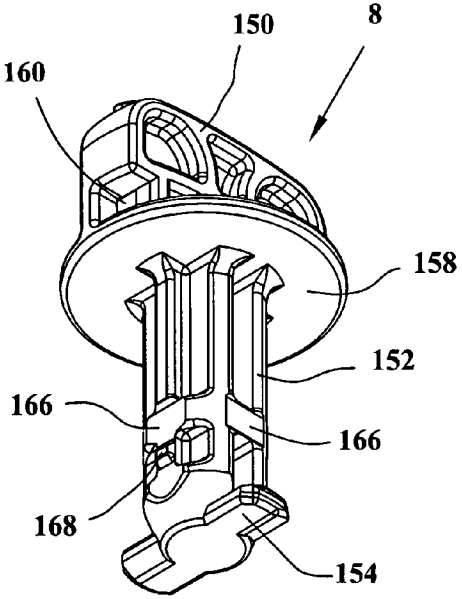

Referring now to FIGS. 12-14, the locking element 8 is shown which is generally defined by a handle portion 150, a shank portion 152 and a rotatable latching member 154; the shank portion 152 and rotatable latching member 154 defining a key member. The handle portion 150 is integral with a top portion 156 which defines a stop surface at 158. Handle 150 also includes a through opening at 160 which extends through at least a portion of the handle 150. Shank portion 152 includes detent members in the form of flats 166 and includes protrusions 168.

Figure 15:
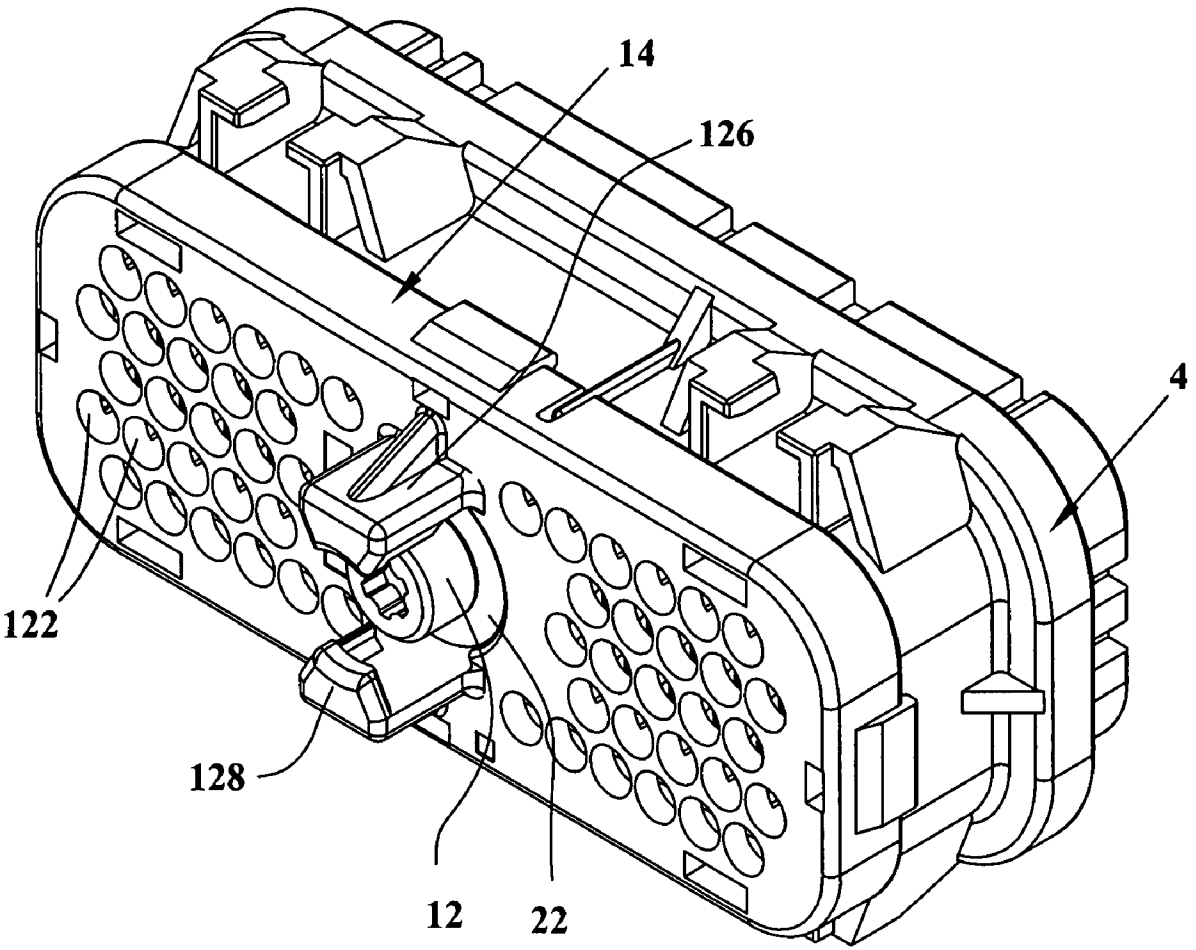
FIG. 15 shows a perspective view of the seal cover and plug housing latched together.

With the above described components and elements, the assembly and use of the connector assembly will now be described. With respect first to FIGS. 2, 7, 8 and 15, a subassembly is provided by placing the O-ring 24 in channel 90 (FIG. 7), and by placing retention insert 18 and mat seal 16 within the inner space 94 (FIG. 8) defined in the plug housing 4. Seal cover 14 may now be snapped to plug housing 4 as shown in FIG. 15 and jack screw 12 together with washer 22 and O-ring 20 may be positioned in opening 140 (FIG. 11) intermediate arms 126. As mentioned above, this places the threaded portion of jack screw 12 within the enlarged opening 102 (FIG. 7). This also seats washer 22 on shoulder 142. At this point, a plurality of contacts terminated to insulated conductors may be positioned through apertures 122 of seal cover 14, through mat seal 16, through contact retainer 18 and finally into apertures 86 (FIGS. 7 and 8). As is known in the art, retaining nut 26 may be positioned around the jack screw 12 which retains the jack screw longitudinally within the assembly of the FIG. 15 components, but allows free rotational movement of the jack screw 12.

Figure 16:
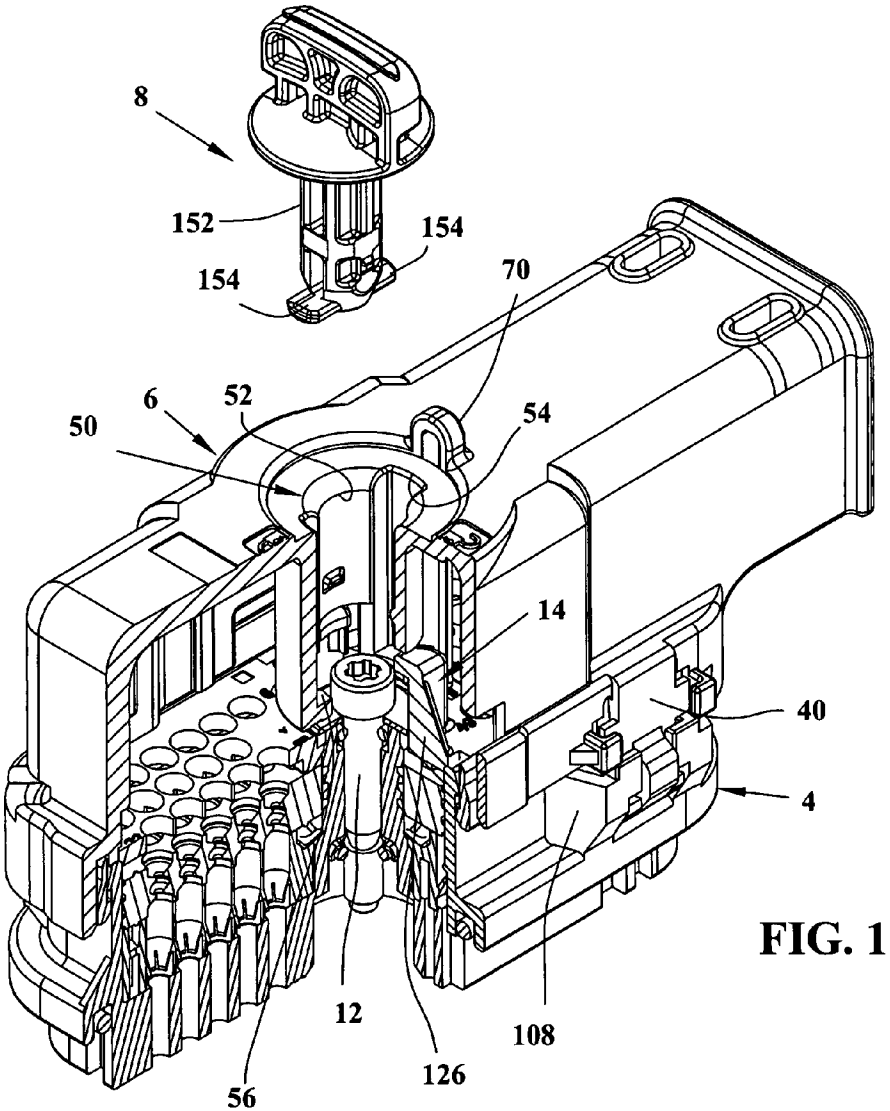
FIG. 16 shows a partial cutaway view of the wire dress cover assembled to the seal cover and plug housing with the locking element poised for receipt into the wire dress housing.
Figure 17:
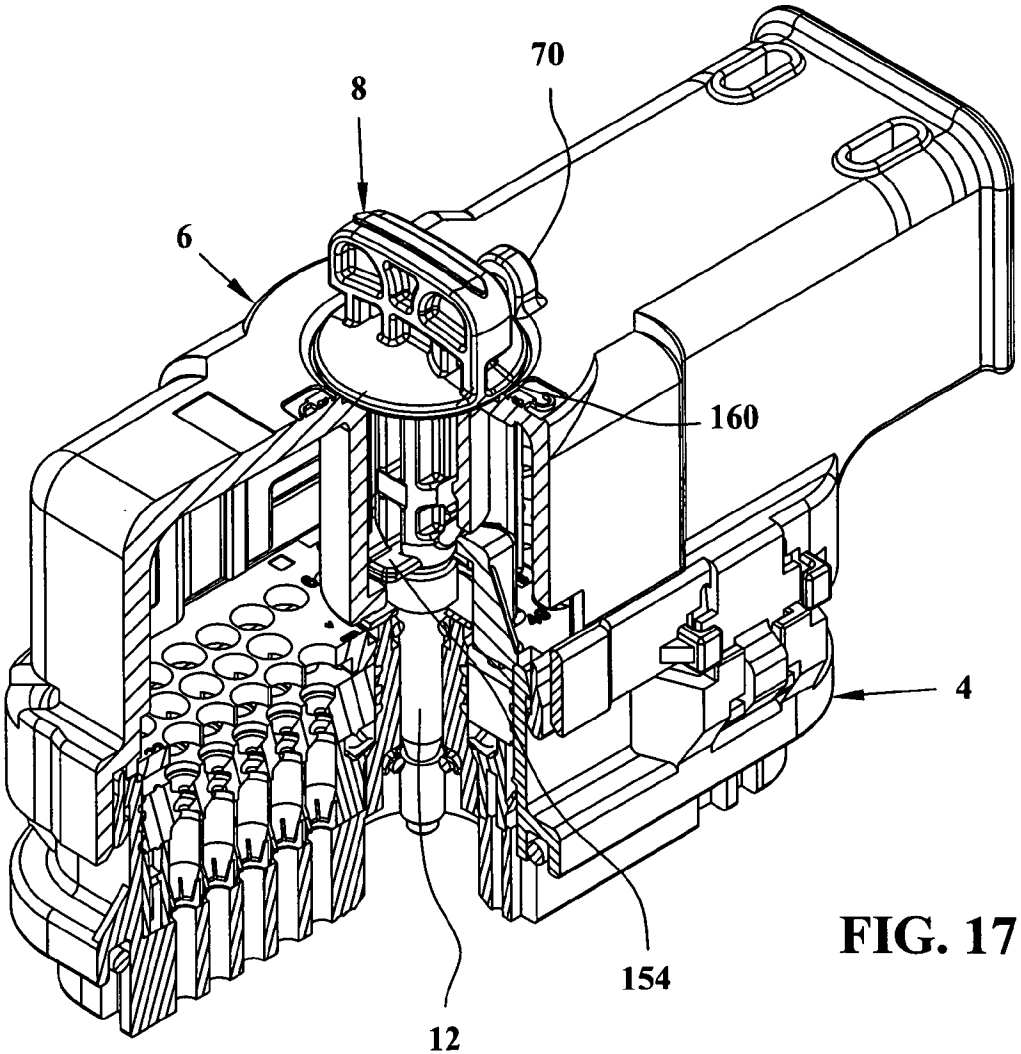
FIG. 17 shows a partial cut away view of the locking element in the unlocked position.

It should be appreciated that wire dress cover 6 may now be positioned over the assembly of FIG. 15 with cooperating latches 40 and 108 retaining the wire dress cover 6 to plug housing 4. As shown in FIG. 16, with the wire dress cover 6 snapped in place to plug housing 4, access opening 50 communicates with the jack screw 12 and with the arms 126 which extend upwardly from the seal cover 14. Thus the FIG. 16 configuration may be connected to a mating device with the jack screw connecting the assembly to the mating device. With respect now to FIGS. 16 and 17, locking element 8 is shown with the rotational latching members 154 aligned with keyway slots 54. It should be appreciated that rotational latching members 154 may be slideably received into the keyway slots which positions the shank 152 within the cylindrical portion 52 of the wire dress cover 6. When the locking element 8 is inserted into the wire dress cover 6 as shown in FIG. 16, the rotational latching members 154 are received within the radial openings 144 (FIG. 11); and are intermediate each of the arms 126, with shank portion 152 covering the top of the jack screw 12. An axial detent is provided between protrusions 168 (FIG. 12) on shank 152 and between detents 68 (FIG. 5) on wire dress cover 6. This position is shown by FIG. 17.

Figure 18:
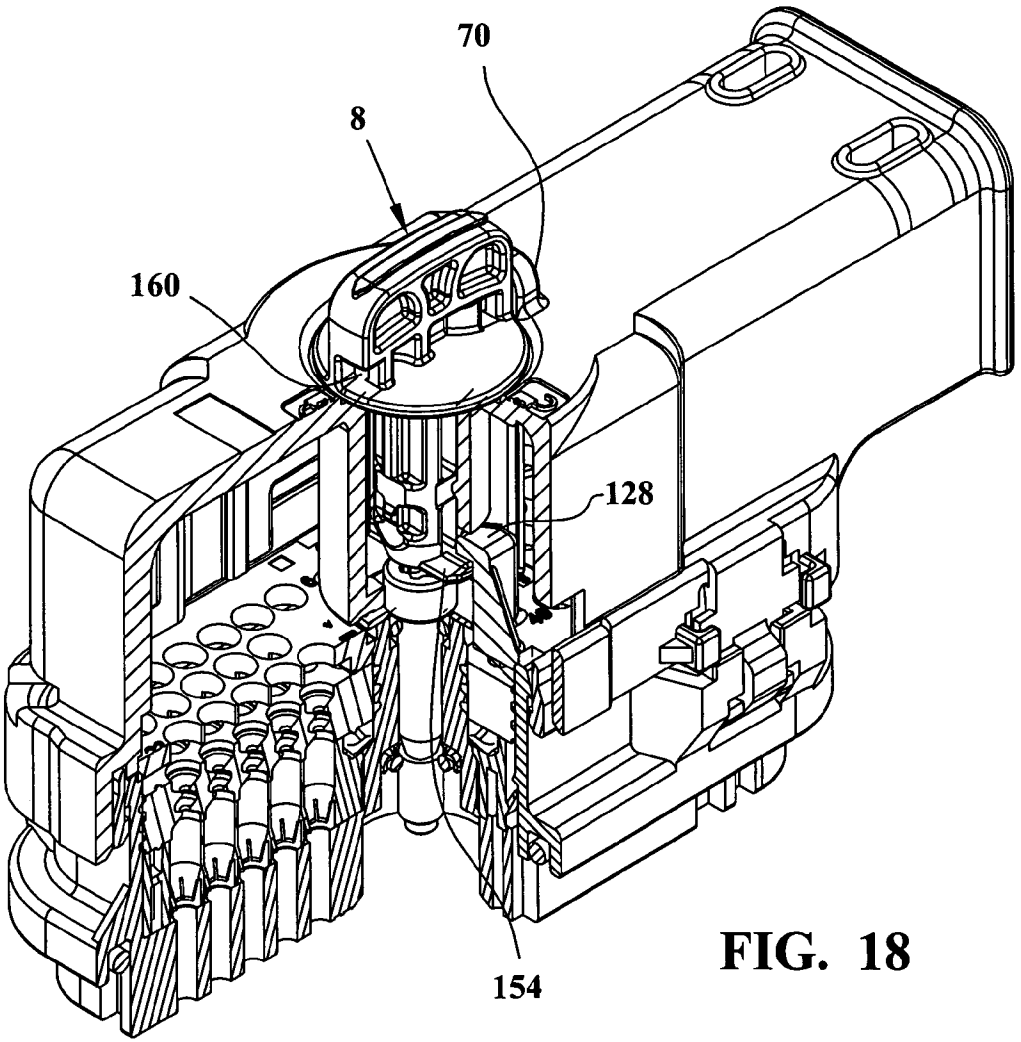
FIG. 18 shows a partial cut away view of the locking element in the locked position.

With respect now to FIG. 18, the locking element 8 may now be rotated clockwise to the position shown in FIG. 18 whereby the rotational latching members 154 are rotationally received under shoulders 128 whereby locking element is fixed in place. It should also be appreciated that a tactile snapping detent feel is encountered during the rotation of locking element 8 due to the interaction between detents 68 (FIG. 5) and the flats 166 (FIG. 12). At this point, a serialized lock wire 10 (FIG. 1) may be positioned through tab 70 and through opening 160 of locking member 8 which locks the locking member 8 in a fixed rotational sense relative to the wire dress cover 6. This design provides evidence of tampering, as the locking element 8 or wire dress cover 6 needs to be removed to reach the jack screw, and the wire 10 needs to be removed to remove the locking element. If the wire dress cover 6 is forcibly removed from the plug housing or the connector is "unmated" by turning the jack screw without first un-locking the locking member 8, the rotational latching members 154 or the wire attachment features will break and provide evidence of tampering.

Figure 20:
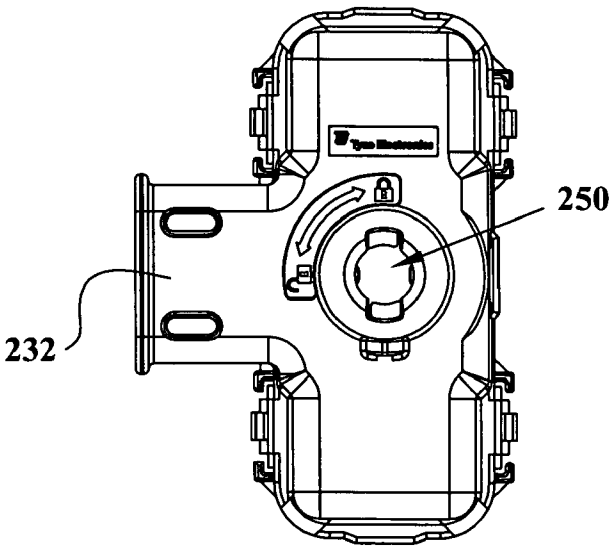
FIGS. 19 and 20 show an alternate wire dress cover.
Figure 19:
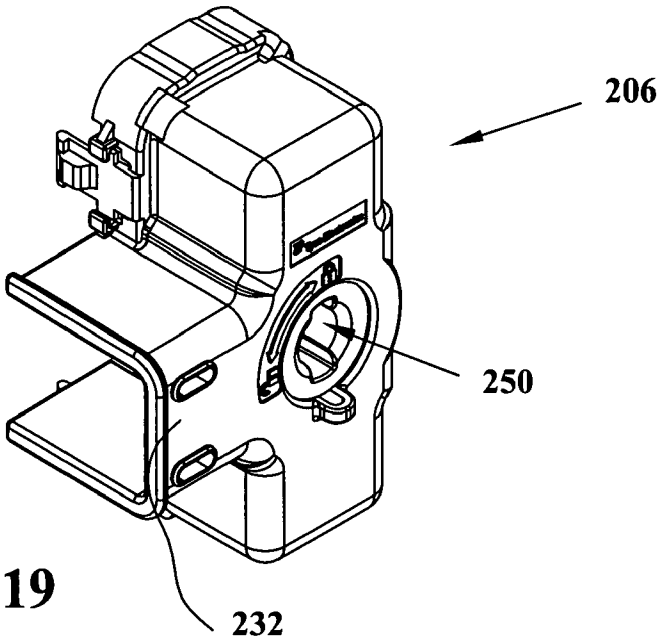

It should be appreciated that numerous different configurations are conceivable using the teachings of the present application. For example, and with reference to FIGS. 19 and 20, another version of wire dress cover is shown at 206, having a wire dress shroud at 232 and an access opening at 250. Multiple other configurations are possible, without departing from the teachings herein. Although most of the teachings herein represent a rotating locking member, it should also be appreciated that a locking member that slides into locked position rather than rotating is not a departure from this invention.

What is claimed is:

1. An electrical connector assembly for attachment to a mating device, comprising:

a plug housing assembly;

an attachment mechanism for attaching the plug housing assembly to the mating device;

a wire dress cover attached to the plug housing assembly, with an access opening communicating with the attachment mechanism;

the attachment mechanism extending through the plug housing assembly, with a portion of the attachment member positioned within the wire dress cover; and a locking element, receivable in the access opening and covering the portion of the attachment mechanism positioned within the wire dress cover, and being retainable to the wire dress cover.

2. An electrical connector assembly of claim 1, wherein the plug housing assembly is comprised of a plug housing and a seal cover.

3. An electrical connector assembly of claim 2, further comprising a mat seal, wherein the seal cover traps the mat seal in place to the plug housing.

4. An electrical connector assembly of claim 2, wherein the seal cover and the locking element comprise cooperable latching members.

5. An electrical connector assembly of claim 4, wherein the cooperable latching members comprise at least one fixed latching member on the seal cover and at least one rotatable latching member on the locking element, wherein upon rotation of the locking element, the rotatable latching member cooperates with the fixed latching member.

6. An electrical connector assembly of claim 5, wherein the fixed latching member is comprised of arms extending towards the wire dress cover and having shoulders providing an inner latching edge.

7. An electrical connector assembly of claim 6, wherein the locking element is comprised of a key member, and the rotatable latching member is receivable under the shoulders of the fixed latching member.

8. An electrical connector assembly of claim 7, wherein the fixed latching member has a radial opening adjacent to the arms and the wire dress cover includes an alignment keyway aligning the key member with the radial opening adjacent the fixed latching member.

9. An electrical connector assembly of claim 8, wherein the alignment keyway and the shoulders of the fixed latching member, overlap longitudinally.

10. An electrical connector assembly of claim 1, wherein the locking element is secured to the wire dress cover to prevent tampering with the plug housing assembly.

11. An electrical connector assembly, comprising:

a first housing;

a second housing latched to the first housing, the second housing having latching arms with latching surfaces;

a cover attached to the first and second housing, with an access opening accessing the latching arms;

a locking element, receivable in the access opening and retainable to the latching arms, retaining the cover and the second housing together; and wherein the first housing further comprises an attachment mechanism for attaching the connector assembly to a mating device.

12. An electrical connector assembly of claim 11, wherein the cover and the locking element comprise cooperable latching members.

13. An electrical connector assembly of claim 11, further comprising a mat seal, wherein the second housing traps the mat seal in place to the plug housing.

14. An electrical connector assembly of claim 12, wherein the cooper able latching members comprise at least one fixed latching member on the second housing and at least one rotatable latching member on the locking element, wherein upon rotation of the locking element, the rotatable latching member cooperates with the fixed latching member.

15. An electrical connector assembly of claim 14, wherein the fixed latching member is comprised of arms extending towards the cover and having shoulders providing an inner latching edge.

16. An electrical connector assembly of claim 15, wherein the locking element is comprised of a key member, and the rotatable latching member is receivable under the shoulders of the fixed latching member.

17. An electrical connector assembly of claim 16, wherein the fixed latching member has radial openings adjacent the arms and the cover includes an alignment keyway aligning the key member with the radial opening adjacent the fixed latching member.

18. An electrical connector assembly of claim 17, wherein alignment keyway and the shoulders of the fixed latching member, overlap longitudinally.

19. An electrical connector assembly of claim 11, wherein the locking element may be secured to the plug connector to provide tampering evidence for the plug housing assembly.

* * * * *